US009006628B2

(12) United States Patent
Roemerman et al.

(10) Patent No.: US 9,006,628 B2
(45) Date of Patent: Apr. 14, 2015

(54) SMALL SMART WEAPON AND WEAPON SYSTEM EMPLOYING THE SAME

(75) Inventors: Steven D. Roemerman, Highland Village, TX (US); John P. Volpi, Garland, TX (US)

(73) Assignee: Lone Star IP Holdings, LP, Addison, TX (US)

( * ) Notice: Subject to any disclaimer, the term of this patent is extended or adjusted under 35 U.S.C. 154(b) by 0 days.

(21) Appl. No.: 12/754,390

(22) Filed: Apr. 5, 2010

(65) Prior Publication Data

US 2012/0119013 A1 May 17, 2012

Related U.S. Application Data

(62) Division of application No. 11/541,207, filed on Sep. 29, 2006, now Pat. No. 7,690,304.

(60) Provisional application No. 60/722,475, filed on Sep. 30, 2005.

(51) Int. Cl.

| | |
|---|---|
| ***F42B 15/01*** | (2006.01) |
| ***F42C 15/20*** | (2006.01) |
| ***F42C 15/40*** | (2006.01) |
| ***F42B 25/00*** | (2006.01) |
| ***F42B 12/04*** | (2006.01) |
| ***F42B 12/36*** | (2006.01) |
| ***F42B 12/44*** | (2006.01) |
| ***F42C 15/00*** | (2006.01) |

(52) U.S. Cl.

CPC ..... *F42B 25/00* (2013.01); *F42B 12/04* (2013.01); *F42B 12/362* (2013.01); *F42B 12/44* (2013.01); *F42C 15/005* (2013.01); *F42C 15/20* (2013.01)

(58) Field of Classification Search

USPC ..... 89/1.8, 1.806, 1.812, 1.819, 6.5, 1.51, 89/1.53, 1.54, 1.55, 1.58; 102/262; 244/3.14, 3.15, 3.19

See application file for complete search history.

(56) References Cited

U.S. PATENT DOCUMENTS

| | | | |
|---|---|---|---|
| 1,039,850 | A | 10/1912 | Völler |
| 1,077,989 | A | 11/1913 | Maxim |
| 1,240,217 | A | 9/1917 | Ingram |
| 1,312,764 | A | 8/1919 | Straub |

(Continued)

FOREIGN PATENT DOCUMENTS

| | | | |
|---|---|---|---|
| EP | 0 298 494 | A2 | 1/1989 |
| GB | 2280736 | A | 2/1995 |

OTHER PUBLICATIONS

U.S. Appl. No. 10/841,192, filed May 7, 2004, Roemerman, et al.

(Continued)

*Primary Examiner* — Bret Hayes

(74) *Attorney, Agent, or Firm* — Boisbrun Hofman, PLLC

(57) ABSTRACT

A weapon and weapon system, and methods of manufacturing and operating the same. In one embodiment, the weapon includes a warhead having destructive elements. The weapon also includes a folding lug switch assembly that provides a mechanism to attach the weapon to a delivery vehicle and is configured to close after launching from the delivery vehicle, thereby satisfying a criterion to arm the warhead. The weapon still further includes a guidance section including an antenna configured to receive mission data before launching from the delivery vehicle and further configured to receive instructions after launching from the delivery vehicle to guide the weapon to a target.

15 Claims, 2 Drawing Sheets

(56) References Cited

U.S. PATENT DOCUMENTS 1,550,622 A 8/1925 Lesh
1,562,495 A 11/1925 Dalton
1,765,017 A 6/1930 Felix Marie
2,295,442 A 9/1942 Wilhelm
2,350,140 A 5/1944 Wilton
2,397,088 A 3/1946 Clay
2,445,311 A 7/1948 Cooke et al.
2,621,732 A 12/1952 Ahlgren
2,737,889 A 3/1956 Barker
2,767,656 A 10/1956 Zeamer
2,809,583 A 10/1957 Ortynsky et al.
2,852,981 A 9/1958 Caya
2,911,914 A 11/1959 Wynn et al.
2,934,286 A 4/1960 Kiernan
2,958,260 A 11/1960 Anderson
3,094,934 A 6/1963 Anthony
3,211,057 A 10/1965 White, Jr. et al.
3,242,861 A 3/1966 Reed, Jr.
3,332,348 A 7/1967 Myers et al.
3,372,890 A 3/1968 Bogard et al.
3,377,952 A 4/1968 Crockett
3,379,131 A 4/1968 Webb
3,387,606 A 6/1968 Crafts et al.
3,416,752 A 12/1968 Hembree
3,429,262 A 2/1969 Kincheloe et al.
3,440,963 A 4/1969 Luca
3,541,394 A 11/1970 Brenneman et al.
3,545,383 A 12/1970 Lucy
3,555,826 A 1/1971 Bennett
3,625,106 A 12/1971 Russo et al.
3,625,152 A 12/1971 Schneider, Jr. et al.
3,626,415 A 12/1971 Montgomery
3,635,162 A 1/1972 Lohkamp et al.
3,667,342 A 6/1972 Warnock et al.
3,667,392 A 6/1972 Grantham et al.
3,703,844 A 11/1972 Bleikamp, Jr.
3,712,228 A 1/1973 Handler et al.
3,728,935 A 4/1973 Magorian
3,739,726 A 6/1973 Pintell
3,759,466 A 9/1973 Evers-Euterneck
3,763,786 A 10/1973 MacDonald
3,771,455 A 11/1973 Haas
3,786,757 A 1/1974 Goldstein et al.
3,789,337 A 1/1974 Sheppard
3,820,106 A 6/1974 Yamashita et al.
3,872,770 A 3/1975 McGuire
3,887,991 A 6/1975 Panella
3,941,059 A 3/1976 Cobb
3,943,854 A 3/1976 Zwicker
3,954,060 A 5/1976 Haag et al.
3,956,990 A 5/1976 Rowe
3,995,792 A 12/1976 Otto et al.
3,998,124 A 12/1976 Milhous et al.
4,015,527 A 4/1977 Evans
4,036,140 A 7/1977 Korr et al.
4,063,508 A 12/1977 Whiting
4,091,734 A 5/1978 Redmond et al.
4,106,726 A 8/1978 Emmons et al.
4,109,579 A 8/1978 Carter
4,112,843 A 9/1978 Laviolette
4,172,407 A 10/1979 Wentink
4,211,169 A 7/1980 Brothers
4,291,848 A 9/1981 Clark
4,364,531 A 12/1982 Knoski
4,383,661 A 5/1983 Ottenheimer et al.
4,408,537 A 10/1983 Fortier
4,430,941 A 2/1984 Raech, Jr. et al.
4,478,127 A 10/1984 Hennings et al.
4,498,394 A 2/1985 Regebro
4,522,356 A 6/1985 Lair et al.
4,616,554 A 10/1986 Spink et al.
4,625,646 A 12/1986 Pinson
4,638,737 A 1/1987 McIngvale
4,648,324 A 3/1987 McDermott
4,709,877 A 12/1987 Goulding
4,714,020 A 12/1987 Hertsgaard et al.
4,744,301 A 5/1988 Cardoen
4,750,404 A 6/1988 Dale
4,750,423 A 6/1988 Nagabhushan
4,756,227 A 7/1988 Ash et al.
4,770,101 A 9/1988 Robertson et al.
4,775,432 A 10/1988 Kolonko et al.
4,777,882 A 10/1988 Dieval
4,803,928 A 2/1989 Kramer et al.
4,824,053 A 4/1989 Sarh
4,834,531 A 5/1989 Ward
4,842,218 A 6/1989 Groutage et al.
4,860,969 A 8/1989 Muller et al.
4,870,885 A 10/1989 Grosselin et al.
4,882,970 A 11/1989 Kovar
4,922,799 A 5/1990 Bartl et al.
4,922,826 A 5/1990 Busch et al.
4,932,326 A 6/1990 Ladriere
4,934,269 A 6/1990 Powell
4,936,187 A 6/1990 Teeter
4,957,046 A 9/1990 Puttock
4,996,923 A 3/1991 Theising
5,027,413 A 6/1991 Barnard
5,034,686 A 7/1991 Aspelin
5,056,408 A 10/1991 Joner et al.
5,088,381 A 2/1992 Lamarque et al.
5,107,766 A 4/1992 Schliesske et al.
5,107,767 A 4/1992 Schneider et al.
5,127,605 A 7/1992 Atchison et al.
5,132,843 A 7/1992 Aoyama et al.
5,231,928 A 8/1993 Phillips et al.
5,311,820 A 5/1994 Ellingsen
5,322,998 A 6/1994 Jackson
5,325,786 A 7/1994 Petrovich
5,348,596 A 9/1994 Goleniewski et al.
5,413,048 A 5/1995 Werner et al.
5,438,366 A 8/1995 Jackson et al.
5,440,994 A 8/1995 Alexander
5,445,861 A 8/1995 Newton et al.
5,451,014 A 9/1995 Dare et al.
5,461,982 A 10/1995 Boyer
5,467,940 A 11/1995 Steuer
5,529,262 A 6/1996 Horwath
5,541,603 A 7/1996 Read et al.
5,546,358 A 8/1996 Thomson
5,561,261 A 10/1996 Lindstädt et al.
5,567,906 A 10/1996 Reese et al.
5,567,912 A 10/1996 Manning et al.
5,681,008 A 10/1997 Kinstler
5,682,266 A 10/1997 Meyers
5,691,502 A 11/1997 Craddock et al.
5,698,815 A 12/1997 Ragner
5,722,058 A * 2/1998 Umemoto et al. ..... 455/140
5,728,968 A 3/1998 Buzzett et al.
5,796,031 A 8/1998 Sigler
5,816,532 A 10/1998 Zasadny et al.
5,834,684 A 11/1998 Taylor
5,853,143 A * 12/1998 Bradley et al. ..... 244/3.21
5,969,864 A 10/1999 Chen et al.
5,978,139 A 11/1999 Hatakoshi et al.
5,988,071 A 11/1999 Taylor
6,019,317 A 2/2000 Simmons et al.
6,021,716 A 2/2000 Taylor
6,105,505 A 8/2000 Jones
6,174,494 B1 1/2001 Lowden et al.
6,216,595 B1 4/2001 Lamorlette et al.
6,253,679 B1 7/2001 Woodall et al.
6,293,202 B1 * 9/2001 Woodall et al. ..... 102/387
6,324,985 B1 12/2001 Petrusha
6,338,242 B1 1/2002 Kim et al.
6,349,898 B1 2/2002 Leonard et al.
6,374,744 B1 4/2002 Schmacker et al.
6,389,977 B1 5/2002 Schmacker et al.
6,523,477 B1 2/2003 Brooks et al.
6,523,478 B1 2/2003 Gonzalez et al.
6,540,175 B1 4/2003 Mayersak et al.
6,546,838 B2 4/2003 Zavitsanos et al.
6,604,436 B1 8/2003 Lewandowski et al.
6,615,116 B2 9/2003 Ebert

(56) References Cited

U.S. PATENT DOCUMENTS

| | | | | |
|---|---|---|---|---|
| 6,666,123 | B1 | 12/2003 | Adams et al. | |
| 6,679,454 | B2 | 1/2004 | Olsen et al. | |
| 6,691,947 | B2 | 2/2004 | La Fata | |
| 6,705,571 | B2 | 3/2004 | Shay | |
| 6,779,754 | B2 | 8/2004 | Hellman | |
| 6,832,740 | B1 | 12/2004 | Ransom | |
| 6,834,835 | B1 | 12/2004 | Knowles et al. | |
| 6,869,044 | B2 | 3/2005 | Geswender et al. | |
| 6,871,817 | B1 | 3/2005 | Knapp | |
| 6,880,780 | B1 | 4/2005 | Perry et al. | |
| 6,910,661 | B2 | 6/2005 | Dockter et al. | |
| 6,933,877 | B1 | 8/2005 | Halladay et al. | |
| 7,019,650 | B2 | 3/2006 | Volpi et al. | |
| 7,032,858 | B2 | 4/2006 | Williams | |
| 7,051,974 | B2 | 5/2006 | Stuhr | |
| 7,083,140 | B1 | 8/2006 | Dooley | |
| 7,121,210 | B2 | 10/2006 | Steele | |
| 7,143,698 | B2 | 12/2006 | Lloyd | |
| 7,156,347 | B2 | 1/2007 | Lam et al. | |
| 7,221,847 | B2 | 5/2007 | Gardiner et al. | |
| 7,325,769 | B1 | 2/2008 | Harnisch et al. | |
| 7,338,009 | B1 * | 3/2008 | Bobinchak et al. | 244/3.15 |
| 7,340,986 | B1 | 3/2008 | Gaigler | |
| 7,474,476 | B2 | 1/2009 | Ueta et al. | |
| 7,503,527 | B1 | 3/2009 | Fairchild | |
| 7,530,315 | B2 | 5/2009 | Tepera et al. | |
| 7,690,304 | B2 * | 4/2010 | Roemerman et al. | 102/222 |
| 7,789,343 | B2 | 9/2010 | Sarh et al. | |
| 7,895,946 | B2 | 3/2011 | Roemerman et al. | |
| 7,958,810 | B2 | 6/2011 | Roemerman et al. | |
| 8,016,249 | B2 | 9/2011 | Sar et al. | |
| 8,042,471 | B2 | 10/2011 | Michel et al. | |
| 8,049,869 | B2 | 11/2011 | Flowers et al. | |
| 8,117,955 | B2 | 2/2012 | Roemerman et al. | |
| 8,127,683 | B2 | 3/2012 | Tepera et al. | |
| 8,502,126 | B2 | 8/2013 | Tyree | |
| 8,541,724 | B2 | 9/2013 | Roemerman | |
| 8,661,980 | B1 | 3/2014 | Roemerman et al. | |
| 8,661,981 | B2 | 3/2014 | Roemerman et al. | |
| 2003/0051629 | A1 | 3/2003 | Zavitsanos et al. | |
| 2003/0056680 | A1 | 3/2003 | Santacreu | |
| 2003/0123159 | A1 | 7/2003 | Morita et al. | |
| 2003/0146342 | A1 | 8/2003 | Hellman | |
| 2003/0192992 | A1 | 10/2003 | Olsen et al. | |
| 2004/0159261 | A1 * | 8/2004 | Steele | 102/477 |
| 2004/0174261 | A1 | 9/2004 | Volpi et al. | |
| 2005/0127242 | A1 | 6/2005 | Rivers, Jr. | |
| 2005/0168375 | A1 * | 8/2005 | Halladay et al. | 342/14 |
| 2005/0180337 | A1 | 8/2005 | Roemerman et al. | |
| 2005/0201450 | A1 | 9/2005 | Volpi et al. | |
| 2005/0274844 | A1 | 12/2005 | Stuhr | |
| 2006/0017545 | A1 | 1/2006 | Volpi et al. | |
| 2006/0077036 | A1 | 4/2006 | Roemerman et al. | |
| 2006/0198033 | A1 | 9/2006 | Soyama et al. | |
| 2007/0035383 | A1 | 2/2007 | Roemerman et al. | |
| 2007/0157843 | A1 | 7/2007 | Roemerman et al. | |
| 2008/0062412 | A1 | 3/2008 | Kravitz | |
| 2009/0026321 | A1 | 1/2009 | Sarh et al. | |
| 2009/0078146 | A1 | 3/2009 | Tepera et al. | |
| 2009/0100995 | A1 | 4/2009 | Fisher | |
| 2009/0228159 | A1 | 9/2009 | Flowers | |
| 2009/0267847 | A1 * | 10/2009 | Sato et al. | 343/713 |
| 2010/0031841 | A1 | 2/2010 | Michel et al. | |
| 2010/0264253 | A1 | 10/2010 | Taylor et al. | |
| 2010/0282893 | A1 | 11/2010 | Roemerman et al. | |
| 2010/0326264 | A1 | 12/2010 | Roemerman et al. | |
| 2011/0017864 | A1 | 1/2011 | Roemermann et al. | |
| 2011/0108660 | A1 | 5/2011 | Roemerman et al. | |
| 2011/0179963 | A1 | 7/2011 | Tepera et al. | |
| 2011/0233322 | A1 | 9/2011 | Holicki et al. | |
| 2012/0119013 | A1 | 5/2012 | Roemerman et al. | |
| 2012/0145822 | A1 | 6/2012 | Roemerman et al. | |
| 2012/0152091 | A1 | 6/2012 | Roemerman et al. | |
| 2012/0199689 | A1 | 8/2012 | Burkland | |
| 2012/0256730 | A1 | 10/2012 | Scott et al. | |
| 2012/0292431 | A1 | 11/2012 | Patel et al. | |
| 2014/0026777 | A1 | 1/2014 | Tepera et al. | |

OTHER PUBLICATIONS

Andersson, O., et al., "High Velocity Jacketed Long Rod Projectiles Hitting Oblique Steel Plates," 19th International Symposium of Ballistics, May 7-11, 2001, pp. 1241-1247, Interlaken, Switzerland.

Davitt, R.P., "A Comparison of the Advantages and Disadvantages of Depleted Uranium and Tungsten Alloy as Penetrator Materials," Tank Ammo Section Report No. 107, Jun. 1980, 32 pages, U.S. Army Armament Research and Development Command, Dover, NJ.

"DOE Handbook: Primer on Spontaneous Heating and Pyrophoricity," Dec. 1994, 87 pages, DOE-HDBK-1081-94, FSC-6910, U.S. Department of Energy, Washington, D.C.

Rabkin, N.J., et al., "Operation Desert Storm: Casualties Caused by Improper Handling of Unexploded U.S. Submunitions," GAO Report to Congressional Requestors, Aug. 1993, 24 pages, GAO/NSIAD-93-212, United States General Accounting Office, Washington, D.C.

Smart, M.C., et al., "Performance Characteristics of Lithium Ion Cells at Low Temperatures," IEEE AESS Systems Magazine, Dec. 2002, pp. 16-20, IEEE, Los Alamitos, CA.

"UNICEF What's New?: Highlight: Unexploded Ordnance (UXO)," http://www.unicef.org.vn/uxo.htm, downloaded Mar. 8, 2005, 3 pages.

* cited by examiner

SMALL SMART WEAPON AND WEAPON SYSTEM EMPLOYING THE SAME

This application is a divisional of patent application Ser. No. 11/541,207, entitled "Small Smart Weapon and Weapon System Employing the Same," filed on Sep. 29, 2006, which claims the benefit of U.S. Provisional Application No. 60/722,475 entitled "Small Smart Weapon (SSW)," filed Sep. 30, 2005, which applications are incorporated herein by reference.

TECHNICAL FIELD

The present invention is directed, in general, to weapon systems and, more specifically, to a weapon and weapon system, and methods of manufacturing and operating the same.

BACKGROUND

Present rules of engagement demand that precision guided weapons and weapon systems are necessary. According to well-documented reports, precision guided weapons have made up about 53 percent of all strike weapons employed by the United States from 1995 to 2003. The trend toward the use of precision weapons will continue. Additionally, strike weapons are used throughout a campaign, and in larger numbers than any other class of weapons. This trend will be even more pronounced as unmanned airborne vehicles ("UAVs") take on attack roles.

Each weapon carried on a launch platform (e.g., aircraft, ship, artillery) must be tested for safety, compatibility, and effectiveness. In some cases, these qualification tests can cost more to perform than the costs of the development of the weapon system. As a result, designers often choose to be constrained by earlier qualifications. In the case of smart weapons, this qualification includes data compatibility efforts. Examples of this philosophy can be found in the air to ground munitions ("AGM")-154 joint standoff weapon ("JSOW"), which was integrated with a number of launch platforms. In the process, a set of interfaces were developed, and a number of other systems have since been integrated which used the data sets and precedents developed by the AGM-154. Such qualifications can be very complex.

An additional example is the bomb live unit ("BLU")-116, which is essentially identical to the BLU-109 warhead in terms of weight, center of gravity and external dimensions. However, the BLU-116 has an external "shroud" of light metal (presumably aluminum alloy or something similar) and a core of hard, heavy metal. Thus, the BLU-109 was employed to reduce qualification costs of the BLU-116.

Another means used to minimize the time and expense of weapons integration is to minimize the changes to launch platform software. As weapons have become more complex, this has proven to be difficult. As a result, the delay in operational deployment of new weapons has been measured in years, often due solely to the problem of aircraft software integration.

Some weapons such as the Paveway II laser guided bomb [also known as the guided bomb unit ("GBU")-12] have no data or power interface to the launch platform. Clearly, it is highly desirable to minimize this form of interface and to, therefore, minimize the cost and time needed to achieve military utility.

Another general issue to consider is that low cost weapons are best designed with modularity in mind. This generally means that changes can be made to an element of the total weapon system, while retaining many existing features, again with cost and time in mind.

Another consideration is the matter of avoiding unintended damage, such as damage to non-combatants. Such damage can take many forms, including direct damage from an exploding weapon, or indirect damage. Indirect damage can be caused by a "dud" weapon going off hours or weeks after an attack, or if an enemy uses the weapon as an improvised explosive device. The damage may be inflicted on civilians or on friendly forces.

One term of reference is "danger close," which is the term included in the method of engagement segment of a call for fire that indicates that friendly forces or non-combatants are within close proximity of the target. The close proximity distance is determined by the weapon and munition fired. In recent United States engagements, insurgent forces fighting from urban positions have been difficult to attack due to such considerations.

To avoid such damage, a number of data elements may be provided to the weapon before launch, examples of such data include information about coding on a laser designator, so the weapon will home in on the right signal. Another example is global positioning system ("GPS") information about where the weapon should go, or areas that must be avoided. Other examples could be cited, and are familiar to those skilled in the art.

Therefore, what is needed is a small smart weapon that can be accurately guided to an intended target with the effect of destroying that target with little or no collateral damage of other nearby locations. Also, what is needed is such a weapon having many of the characteristics of prior weapons already qualified in order to substantially reduce the cost and time for effective deployment.

SUMMARY OF THE INVENTION

These and other problems are generally solved or circumvented, and technical advantages are generally achieved, by advantageous embodiments of the present invention, which includes a weapon and weapon system, and methods of manufacturing and operating the same. In one embodiment, the weapon includes a warhead having destructive elements. The weapon also includes a folding lug switch assembly that provides a mechanism to attach the weapon to a delivery vehicle and is configured to close after launching from the delivery vehicle thereby satisfying a criterion to arm the warhead. The weapon still further includes a guidance section including an antenna configured to receive mission data before launching from the delivery vehicle and further configured to receive instructions after launching from the delivery vehicle to guide the weapon to a target.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
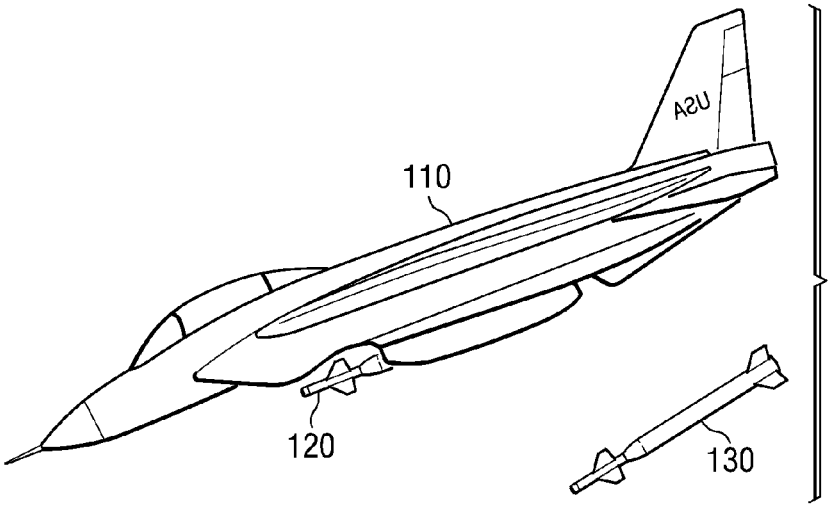
FIG. 1 illustrates a view of an embodiment of a weapon system in accordance with the principles of the present invention.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

It should be understood that the military utility of the weapon can only be fully estimated in the context of a so-called system of systems, which includes a guidance section or system, the delivery vehicle or launch platform, and other things, in addition to the weapon per se. In this sense, a weapon system is disclosed herein, even when we are describing a weapon per se. One example is seen in the discussion of the GBU-12, wherein design choices within the weapon were reflected in the design and operation of many aircraft that followed the introduction of the GBU-12. Another example is the use of a laser designator for laser guided weapons. Design choices in the weapon can enhance or limit the utility of the designator. Other examples can be cited. Those skilled in the art will understand that the discussion of the weapon per se inherently involves a discussion of the larger weapon system of systems. Therefore, improvements within the weapon often result in corresponding changes or improvements outside the weapon, and new teachings about weapons teach about weapon platforms, and other system of systems elements.

In accordance therewith, a class of warhead assemblies, constituting systems, methods, and devices, with many features, including multiple, modular guidance subsystems, avoidance of collateral damage, unexploded ordinance, and undesirable munitions sensitivity is described herein. In an exemplary embodiment, the warheads are Mark derived (e.g., MK-76) or bomb dummy unit ("BDU") derived (e.g., BDU-33) warheads. The MK-76 is about four inches in diameter, 24.5 inches in length, 95-100 cubic inches ("cu") in internal volume, 25 pounds ("lbs") and accommodates a 0.85 inch diameter practice bomb cartridge. This class of assemblies is also compatible with existing weapon envelopes of size, shape, weight, center of gravity, moment of inertia, and structural strength to avoid lengthy and expensive qualification for use with manned and unmanned platforms such as ships, helicopters, self-propelled artillery and fixed wing aircraft, thus constituting systems and methods for introducing new weapon system capabilities more quickly and at less expense. In addition, the weapon system greatly increases the number of targets that can be attacked by a single platform, whether manned or unmanned.

In an exemplary embodiment, the general system envisioned is based on existing shapes, such as the MK-76, BDU-33, or laser guided training round ("LGTR"). The resulting system can be modified by the addition or removal of various features, such as global positioning system ("GPS") guidance, and warhead features. In addition, non-explosive warheads, such as those described in U.S. patent application Ser. No. 10/841,192 entitled "Weapon and Weapon System Employing The Same," to Roemerman, et al., filed May 7, 2004, and U.S. patent application Ser. No. 10/997,617 entitled "Weapon and Weapon System Employing the Same," to Tepera, et al., filed Nov. 24, 2004 (now, U.S. Pat. No. 7,530,315, issued May 12, 2009), which are incorporated herein by reference, may also be employed with the weapon according to the principles of the present invention. Additionally, a related weapon and weapon system is provided in U.S. Patent Application No. 60/773,746 entitled "Low Collateral Damage Strike Weapon," to Roemerman, et al., filed Feb. 15, 2006, (now, U.S. patent application Ser. No. 11/706,489, also, U.S. Patent Application Publication No. 2010/0282893, entitled "Small Smart Weapon and Weapon System Employing the Same, to Roemerman, et al., filed Feb. 15, 2007), which is incorporated herein by reference.

Another feature of the system is the use of system elements for multiple purposes. For example, the central structural element of the MK-76 embodiment includes an optics design with a primary optical element, which is formed in the mechanical structure rather than as a separate component. Another example is the use of an antenna for both radio guidance purposes, such as GPS, and for handoff communication by means such as those typical of a radio frequency identification ("RFID") system. For examples of RFID related systems, see U.S. patent application Ser. No. 11/501,348 (U.S. Patent Application Publication No. 2007/0035385), entitled "Radio Frequency Identification Interrogation Systems and Methods of Operating the Same," to Roemerman, et al., filed Aug. 9, 2006, U.S. Pat. No. 7,019,650 entitled "Interrogator and Interrogation System Employing the Same," to Volpi, et al., issued on Mar. 28, 2006, U.S. Patent Application Publication No. 2006/0077036, entitled "Interrogation System Employing Prior Knowledge About An Object To Discern An Identity Thereof," to Roemerman, et al., filed Sep. 29, 2005, U.S. Patent Application Publication No. 2006/0017545, entitled "Radio Frequency Identification Interrogation Systems and Methods of Operating the Same," to Volpi, et al., filed Mar. 25, 2005, U.S. Patent Application Publication No. 2005/0201450, entitled "Interrogator And Interrogation System Employing The Same," to Volpi, et al., filed Mar. 3, 2005, all of which are incorporated herein by reference.

Referring now to FIG. 1, illustrated is a view of an embodiment of a weapon system in accordance with the principles of the present invention. The weapon system includes a delivery vehicle (e.g., an airplane such as an F-14) 110 and at least one weapon. As demonstrated, a first weapon 120 is attached to the delivery vehicle (e.g., a wing station) and a second weapon 130 is deployed from the delivery vehicle 110 intended for a target. Of course, the first weapon 120 may be attached to a rack in the delivery vehicle or a bomb bay therein.

The weapon system is configured to provide energy as derived, without limitation, from a velocity and altitude of the delivery vehicle 110 in the form of kinetic energy ("KE") and potential energy to the first and second weapons 120, 130 and, ultimately, the warhead and destructive elements therein. The first and second weapons 120, 130 when released from the delivery vehicle 110 provide guided motion for the warhead to the target. The energy transferred from the delivery vehicle 110 as well as any additional energy acquired through the first and second weapons 120, 130 through propulsion, gravity or other parameters, provides the kinetic energy to the warhead to perform the intended mission. While the first and second weapons 120, 130 described with respect to FIG. 1 represent precision guided weapons, those skilled in the art understand that the principles of the present invention also apply to other types of weapons including weapons that are not guided by guidance technology or systems.

In general, it should be understood that other delivery vehicles including other aircraft may be employed such that the weapons contain significant energy represented as kinetic energy plus potential energy. As mentioned above, the kinetic energy is equal to "$\frac{1}{2}mv^2$," and the potential energy is equal to "mgh" where "m" is the mass of the weapon, "g" is gravitational acceleration equal to 9.8 $M/sec^2$, and "h" is the height of the weapon at its highest point with respect to the height of the target. Thus, at the time of impact, the energy of the weapon is kinetic energy, which is directed into and towards the destruction of the target with little to no collateral damage of surroundings. Additionally, the collateral damage may be further reduced if the warhead is void of an explosive charge.

Figure 2:
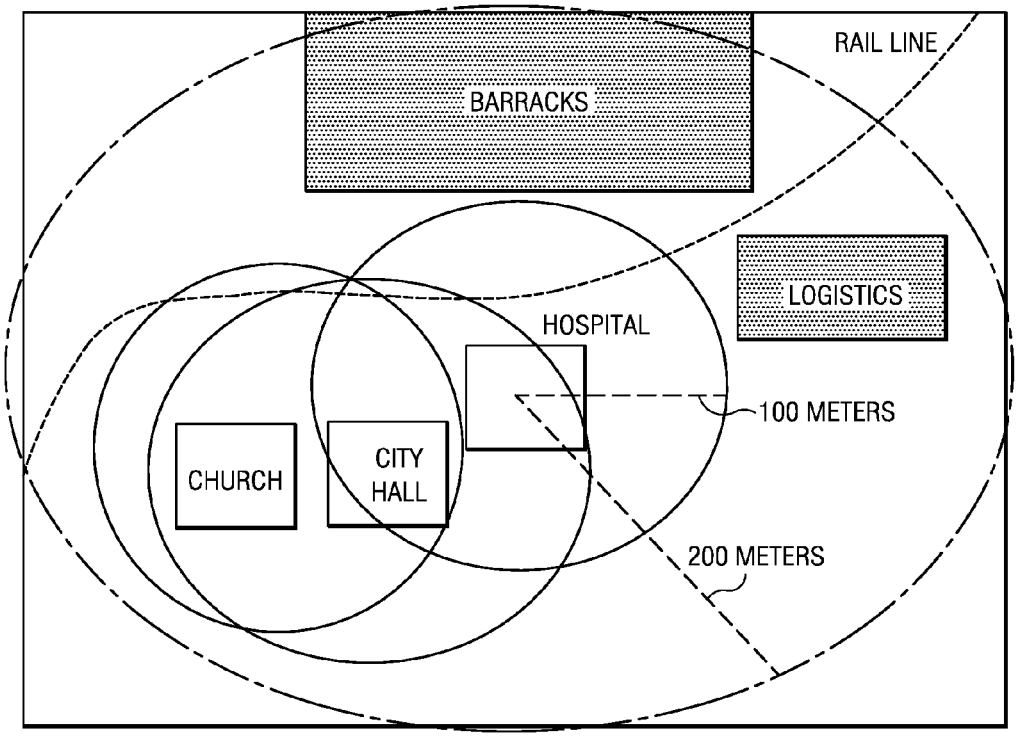
FIG. 2 illustrates a diagram demonstrating a region including a target zone for a weapon system in accordance with the principles of the present invention.

Turning now to FIG. 2, illustrated is a diagram demonstrating a region including a target zone for a weapon system in accordance with the principles of the present invention. The entire region is about 200 meters (e.g., about 2.5 city blocks) and the structures that are not targets take up a significant portion of the region. For instance, the weapon system would not want to target the hospital and a radius including about a 100 meters thereabout. In other words, the structures that are not targets are danger close to the targets. A barracks and logistics structure with the rail line form the targets in the illustrated embodiment.

Figure 3:
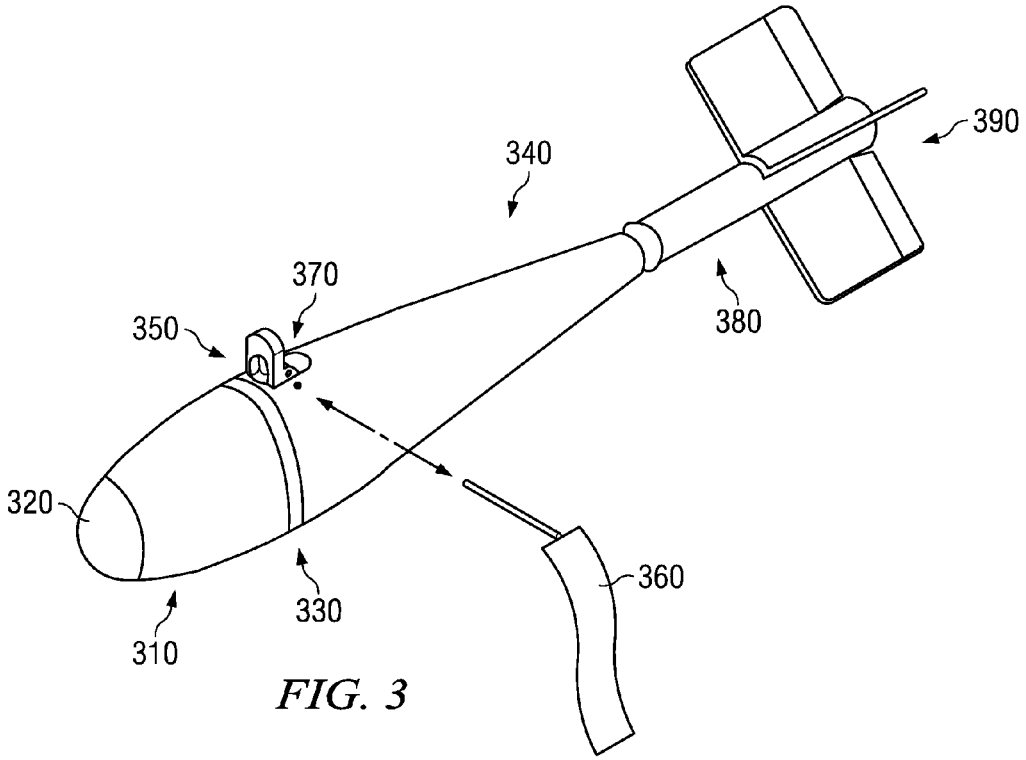
FIG. 3 illustrates a perspective view of an embodiment of a weapon constructed according to the principles of the present invention.

Turning now to FIG. 3, illustrated is a perspective view of an embodiment of a weapon constructed according to the principles of the present invention. The weapon includes a guidance section 310 including a target sensor (e.g., a laser seeker) 320, and guidance and control electronics and logic to guide the weapon to a target. The target sensor 320 may include components and subsystems such as a crush switch, a semi-active laser based terminal seeker ("SAL") quad detector, a net cast corrector and lenses for an optical system. In accordance with SAL systems, net cast optics are suitable, since the spot for the terminal seeker is normally defocused.

The guidance section 310 may include components and subsystems such as a GPS, an antenna such as a ring antenna 330 (e.g., dual use handoff and data and mission insertion similar to radio frequency identification and potentially also including responses from the weapon via similar means), a multiple axis microelectomechanical gyroscope, safety and arming devices, fuzing components, a quad detector, a communication interface [e.g., digital subscriber line ("DSL")], and provide features such as low power warming for fast acquisition and inductive handoff with a personal information manager. In the illustrated embodiment, the antenna 330 is about a surface of the weapon. Thus, the antenna is configured to receive mission data such as location, laser codes, GPS ephemerides and the like before launching from a delivery vehicle to guide the weapon to a target. The antenna is also configured to receive instructions after launching from the delivery vehicle to guide the weapon to the target. The weapon system, therefore, includes a communication system, typically within the delivery vehicle, to communicate with the weapon, and to achieve other goals and ends in the context of weapon system operation. It should be understood that the guidance section 310 contemplates, without limitation, laser guided, GPS guided, and dual mode laser and GPS guided systems. It should be understood that this antenna may be configured to receive various kinds of electromagnetic energy, just as there are many types of RFID tags that are configured to receive various kinds of electromagnetic energy.

The weapon also includes a warhead 340 (e.g., a unitary configuration) having destructive elements (formed from explosive or non-explosive materials), mechanisms and elements to articulate aerodynamic surfaces. A folding lug switch assembly 350, safety pin 360 and cavity 370 are also coupled to the guidance section 310 and the warhead 340. The guidance section 310 is in front of the warhead 340. The folding lug switch assembly 350 projects from a surface of the weapon. The weapon still further includes an aft section 380 behind the warhead 340 including system power elements, a ballast, actuators, flight control elements, and tail fins 390.

For instances when the target sensor is a laser seeker, the laser seeker detects the reflected energy from a selected target which is being illuminated by a laser. The laser seeker provides signals so as to drive the control surfaces in a manner such that the weapon is directed to the target. The tail fins 390 provide both stability and lift to the weapon. Modern precision guided weapons can be precisely guided to a specific target so that considerable explosive energy is often not needed to destroy an intended target. In many instances, kinetic energy discussed herein may be sufficient to destroy a target, especially when the weapon can be directed with sufficient accuracy to strike a specific designated target.

The destructive elements of the warhead 340 may be constructed of non-explosive materials and selected to achieve penetration, fragmentation, or incendiary effects. The destructive elements (e.g., shot) may include an incendiary material such as a pyrophoric material (e.g., zirconium) therein. The term "shot" generally refers a solid or hollow spherical, cubic, or other suitably shaped element constructed of explosive or non-explosive materials, without the aerodynamic characteristics generally associated with, for instance, a "dart." The shot may include an incendiary material such as a pyrophoric material (e.g., zirconium) therein. Inasmuch as the destructive elements of the warhead are a significant part of the weapon, the placement of these destructive elements, in order to achieve the overall weight and center of gravity desired, is an important element in the design of the weapon.

The non-explosive materials applied herein are substantially inert in environments that are normal and under benign conditions. Nominally stressing environments such as experienced in normal handling are generally insufficient to cause the selected materials (e.g., tungsten, hardened steel, zirconium, copper, depleted uranium and other like materials) to become destructive in an explosive or incendiary manner. The latent lethal explosive factor is minimal or non-existent. Reactive conditions are predicated on the application of high kinetic energy transfer, a predominantly physical reaction, and not on explosive effects, a predominantly chemical reaction.

The folding lug switch assembly 350 is typically spring-loaded to fold down upon release from, without limitation, a rack on an aircraft. The folding lug switch assembly 350 permits initialization after launch (no need to fire thermal batteries or use other power until the bomb is away) and provides a positive signal for a fuze. The folding lug switch assembly 350 is consistent with the laser guided bomb ("LGB") strategy using lanyards, but without the logistics issues of lanyards. The folding lug switch assembly 350 also makes an aircraft data and power interface optional and supports a visible "remove before flight" pin. The folding lug switch assembly 350 provides a mechanism to attach the weapon to a delivery vehicle and is configured to close after launching from the delivery vehicle thereby satisfying a criterion to arm the warhead. It should be understood, however, that the folding lug switch assembly 350, which is highly desirable in some circumstances, can be replaced with other means of carriage and suspension, and is only one of many features of the present invention, which can be applied in different combinations to achieve the benefits of the weapon system.

Typically, the safety pin 360 is removed from the folding lug switch assembly 350 and the folding lug switch assembly 350 is attached to a rack of an aircraft to hold the folding lug switch assembly 350 in an open position prior to launch. Thus, the safety pin 360 provides a mechanism to arm the weapon. Once the weapon is launched from the aircraft, the folding lug switch assembly 350 folds down into the cavity 370 and provides another mechanism to arm the weapon. A delay circuit between the folding lug switch assembly 350 and the fuze may be yet another mechanism to arm or provide time to disable the weapon after launch. Therefore, there are often three mechanisms that are satisfied before the weapon is ultimately armed enroute to the target.

A number of circuits are now well understood that use power from radio frequency or inductive fields to power a receiving chip and store data. The antenna includes an interface to terminate with the aircraft interface at the rack for loading relevant mission data including target, location, laser codes, GPS ephemerides and the like before being launched. Programming may be accomplished by a hand-held device similar to a fuze setter or can be programmed by a lower power interface between a rack and the weapon. Other embodiments are clearly possible to those skilled in the art. The antenna serves a dual purpose for handoff and GPS. In other words, the antenna is configured to receive instructions after launching from the delivery vehicle to guide the weapon to the target. Typically, power to the weapon is not required prior to launch, therefore no umbilical cable is needed. Alternative embodiments for power to GPS prior to launch are also contemplated herein.

The modular design of the weapon allows the introduction of features such as GPS and other sensors as well. Also, the use of a modular warhead 340 with heavy metal ballast makes the low cost kinetic [no high explosives ("HE")] design option practical and affordable.

As illustrated in an exemplary embodiment of a weapon in the TABLE 1 below, the weapon may be designed to have a similar envelope, mass, and center of gravity already present in existing aircraft for a practice bomb version thereof. Alternatively, the weapon may be designed with other envelopes, masses, and centers of gravity, as may be available with other configurations, as also being included within the constructs of this invention.

TABLE 1

| FUNCTION | MATERIAL | DENSITY (LB/CU IN) | WEIGHT (LB) | VOLUME (CU IN) |
|---|---|---|---|---|
| Ballast/KE | Tungsten | 0.695 | 20.329 | 29.250 |
| Structure, Metal Augmented Charge ("MAC") Explosive | Aluminum | 0.090 | 0.270 | 3.000 |
| Dome | Pyrex | 0.074 | 0.167 | 2.250 |
| Structure | Steel | 0.260 | 1.430 | 5.500 |
| Guidance | Misc Electronics | 0.033 | 0.800 | 24.000 |
| Primary Explosive | Polymer Bonded Explosive ("PBX") | 0.057 | 2.040 | 36.000 |
| Total | SSW | 0.250 | 25.036 | 100.000 |
| MK-76 | | 0.250 | 25.000 | 100.000 |

In the above example, the weapon is MK-76 derived, but others such as BDU-33 are well within the broad scope of the present invention. The weapon provides for very low cost of aircraft integration. The warhead 340 is large enough for useful warheads and small enough for very high carriage density. The modular design of the weapon allows many variants and is compatible with existing handling and loading methods.

The following TABLEs 2 and 3 provide a comparison of several weapons to accentuate the advantages of small smart weapons such as the MK-76 and BDU-33.

TABLE 2

| CANDIDATE | AIRCRAFT ("A/C") CLEARED | WEIGHT (LB) | DIAMETER (IN - APPROX) | REMARKS |
|---|---|---|---|---|
| LGB/MK-81 | None | 250+ | 10 | Canceled variant |
| MK-76/ BDU33 | All | 25 | 4 | Low drag practice bomb |
| BDU-48 | All | 10 | 3.9 | High drag practice bomb |
| MK-106 | All | 5 | 3.9 | High drag practice bomb |
| SDB | Most US | 285 | 7.5 | GBU-39 Small Dia. Bomb |

TABLE 3

| CANDIDATE | CLEARED ON MANY A/C? | LARGE ENOUGH FOR WARHEAD? | VIABLE FOR EXPORT? | HIGH DENSITY CARRIAGE? | COMPATIBLE WITH TUBE LAUNCH? |
|---|---|---|---|---|---|
| LGB/MK-81 | No | Yes | Yes | No | No |
| MK-76/BDU33 | All | Yes | Yes | Yes | Yes |
| BDU-48 | All | No | Yes | Yes | Yes |
| MK-106 | All | No | Yes | Yes | Yes |
| SDB | Most US | Yes | No | Yes | No |

The aforementioned tables provide a snapshot of the advantages associated with small smart weapons, such as, procurements are inevitable, and the current weapons have limited utility due to political, tactical, and legal considerations. Additionally, the technology is ready with much of it being commercial off-the-shelf technology and the trends reflect these changes. The smart weapons are now core doctrine and contractors can expect production in very large numbers. Compared to existing systems, small smart weapons exhibit smaller size, lower cost, equally high or better accuracy, short time to market, and ease of integration with an airframe, which are key elements directly addressed by the weapon disclosed herein. As an example, the small smart weapon could increase an unmanned combat air vehicle ("UCAV") weapon count by a factor of two or more over a small diameter bomb ("SDB") such as a GBU-39/B.

The small smart weapons also address concerns with submunitions, which are claimed by some nations to fall under the land mine treaty. The submunitions are a major source of unexploded ordnance, causing significant limitations to force maneuvers, and casualties to civilians and blue forces. Submunitions are currently the only practical way to attack area targets, such as staging areas, barracks complexes, freight yards, etc. Unexploded ordnance from larger warheads are a primary source of explosives for improvised explosive devices. While the broad scope of the present invention is not so limited, small smart weapons including small warheads, individually targeted, alleviate or greatly reduce these concerns.

Figure 4:
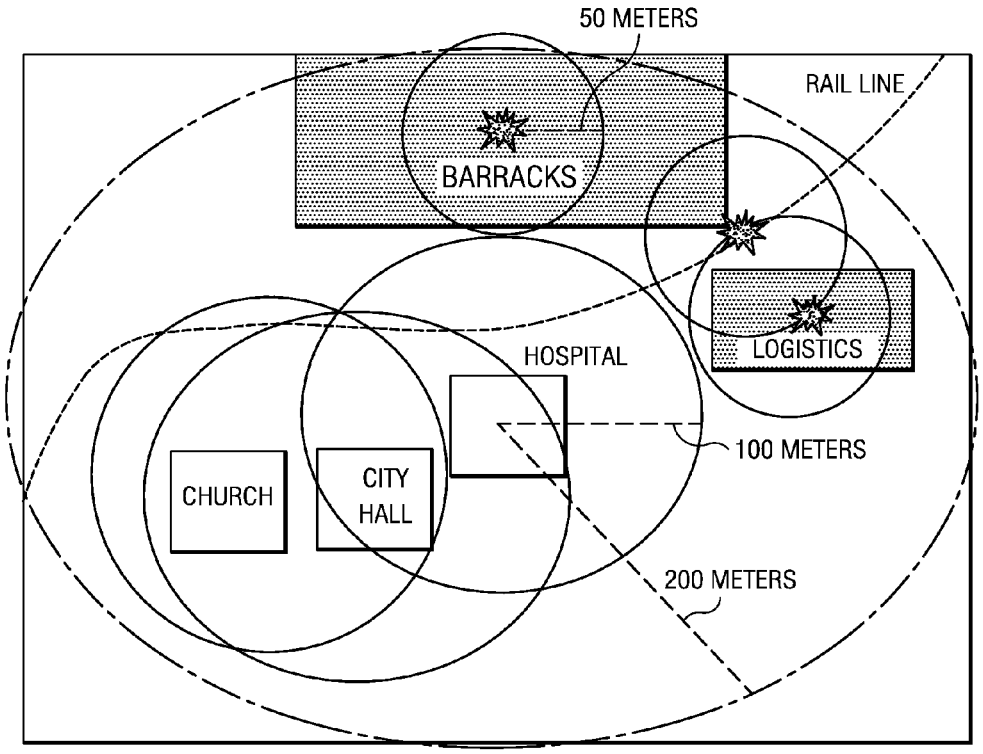
FIG. 4 illustrates a diagram demonstrating a region including a target zone for a weapon system in accordance with the principles of the present invention.

Turning now to FIG. 4, illustrated is a diagram demonstrating a region including a target zone for a weapon system in accordance with the principles of the present invention. Analogous to the regions illustrated with respect to FIG. 2, the entire region is about 200 meters (e.g., about 2.5 city blocks) and the structures that are not targets take up a significant portion of the region. In the illustrated embodiment, the lethal diameter for the weapon is about 10 meters and the danger close diameter is about 50 meters. Thus, when the weapon strikes the barracks, rail line or logistics structure as shown, the weapon according to the principles of the present invention provides little or no collateral damage to, for instance, the hospital. While only a few strikes of a weapon are illustrated herein, it may be preferable to cause many strikes at the intended targets, while at the same time being cognizant of the collateral damage.

In an exemplary embodiment, a sensor of the weapon detects a target in accordance with, for instance, pre-programmed knowledge-based data sets, target information, weapon information, warhead characteristics, safe and arm events, fuzing logic and environmental information. In the target region, sensors and devices detect the target and non-target locations and positions. Command signals including data, instructions, and information contained in the weapon (e.g., a control section) are passed to the warhead. The data, instructions, and information contain that knowledge which incorporates the functional mode of the warhead such as safe and arming conditions, fuzing logic, deployment mode and functioning requirements.

The set of information as described above is passed to, for instance, an event sequencer of the warhead. In accordance therewith, the warhead characteristics, safe and arm events, fuzing logic, and deployment modes are established and executed therewith. At an instant that all conditions are properly satisfied (e.g., a folding lug switch assembly is closed), the event sequencer passes the proper signals to initiate a fire signal to fuzes for the warhead. In accordance herewith, a functional mode for the warhead is provided including range characteristics and the like. Thereafter, the warhead is guided to the target employing the guidance section employing, without limitation, an antenna and global positioning system.

Thus, a class of warhead assemblies, constituting systems, methods, and devices, with many features, including multiple, modular guidance subsystems, avoidance of collateral damage, unexploded ordinance, and undesirable munitions sensitivity has been described herein. The weapon according to the principles of the present invention provides a class of warheads that are compatible with existing weapon envelopes of size, shape, weight, center of gravity, moment of inertia, and structural strength, to avoid lengthy and expensive qualification for use with manned and unmanned platforms such as ships, helicopters, self-propelled artillery and fixed wing aircraft, thus constituting systems and methods for introducing new weapon system capabilities more quickly and at less expense. In addition, the weapon system greatly increases the number of targets that can be attacked by a single platform, whether manned or unmanned.

Additionally, exemplary embodiments of the present invention have been illustrated with reference to specific components. Those skilled in the art are aware, however, that components may be substituted (not necessarily with components of the same type) to create desired conditions or accomplish desired results. For instance, multiple components may be substituted for a single component and vice-versa. The principles of the present invention may be applied to a wide variety of weapon systems. Those skilled in the art will recognize that other embodiments of the invention can be incorporated into a weapon that operates on the principle of lateral ejection of a warhead or portions thereof. Absence of a discussion of specific applications employing principles of lateral ejection of the warhead does not preclude that application from failing within the broad scope of the present invention.

Although the present invention has been described in detail, those skilled in the art should understand that they can make various changes, substitutions and alterations herein without departing from the spirit and scope of the invention in its broadest form. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A weapon, comprising:

a warhead including destructive elements; and a guidance section including a single, ring antenna about a surface of said warhead, said antenna being configured to receive mission data including global positioning system ephemerides employing an inductive field before launching said warhead from a delivery vehicle and further configured to receive instructions after launching said warhead from said delivery vehicle to guide said weapon to a target.

2. The weapon as recited in claim 1 wherein said antenna employs radio frequency to receive said instructions after launching said warhead from said delivery vehicle.

3. The weapon as recited in claim 1 wherein said guidance section employs a global positioning system in cooperation with said antenna to guide said weapon away from areas to be avoided.

4. The weapon as recited in claim 1 further comprising a folding lug switch assembly that provides a mechanism to attach said weapon to said delivery vehicle.

5. The weapon as recited in claim 1 wherein said delivery vehicle is an aircraft and said weapon further comprises a folding lug switch assembly attached to one of a wing station, rack, and bomb bay associated therewith.

6. The weapon as recited in claim 1 further comprising a folding lug switch assembly configured to close after launching said warhead from said delivery vehicle, thereby satisfying a criterion to arm said warhead.

7. The weapon as recited in claim 1 further comprising a safety pin configured to be removed from a folding lug switch assembly, thereby satisfying a criterion to arm said warhead.

8. The weapon as recited in claim 1 wherein said warhead includes destructive elements formed by non-explosive materials.

9. The weapon as recited in claim 1 further comprising an aft section including flight control elements and tail fins.

10. The weapon as recited in claim 1 wherein said weapon is a Mark-76 derived weapon or a bomb dummy unit (BDU)-33 derived weapon.

11. A weapon system, comprising:

a delivery vehicle; and a weapon, including:

a warhead including destructive elements, a guidance section including a single, ring antenna about a surface of said warhead, said antenna being configured to receive mission data including global positioning system ephemerides employing an inductive field before launching said warhead from a delivery vehicle and further configured to receive instructions after launching said warhead from said delivery vehicle to guide said weapon to a target, and an aft section including flight control elements and tail fins.

12. The weapon system as recited in claim 11 wherein said weapon further comprises a folding lug switch assembly that provides a mechanism to attach said weapon to said delivery vehicle and is configured to close after launching said warhead from said delivery vehicle, thereby satisfying a criterion to arm said warhead.

13. The weapon system as recited in claim 12 wherein said weapon further comprises a safety pin configured to be removed from said folding lug switch assembly, thereby satisfying a criterion to arm said warhead.

14. The weapon system as recited in claim 11 wherein said antenna employs radio frequency to receive said instructions after launching said warhead from said delivery vehicle.

15. The weapon system as recited in claim 11 wherein said guidance section employs a global positioning system in cooperation with said antenna to guide said weapon away from areas to be avoided.

* * * * *